US009464459B2

(12) United States Patent
Walls

(10) Patent No.: US 9,464,459 B2
(45) Date of Patent: Oct. 11, 2016

(54) VARIABLE PROGRESSION KEY NOTCHING SYSTEM

(71) Applicant: Schlage Lock Company LLC, Indianapolis, IN (US)

(72) Inventor: Brian Edward Walls, Colorado Springs, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 157 days.

(21) Appl. No.: 14/188,572

(22) Filed: Feb. 24, 2014

(65) Prior Publication Data

US 2015/0240522 A1 Aug. 27, 2015

(51) Int. Cl.
*E05B 19/00* (2006.01)
*E05B 27/00* (2006.01)

(52) U.S. Cl.
CPC ..... *E05B 19/0017* (2013.01); *E05B 19/0023* (2013.01); *E05B 19/0035* (2013.01); *E05B 27/0017* (2013.01); *E05B 27/0039* (2013.01); *E05B 27/0082* (2013.01); *Y10T 70/7881* (2015.04)

(58) Field of Classification Search
CPC ..... Y10T 70/765; Y10T 70/7638; Y10T 70/7864; Y10T 70/7079; Y10T 70/7785; Y10T 70/5341; Y10T 70/761; Y10T 70/7559; Y10T 70/7621; Y10T 70/7791; E05B 27/00; E05B 27/0082; E05B 27/0039
USPC ..... 70/494, 493, 419, 421, 378
See application file for complete search history.

(56) References Cited

U.S. PATENT DOCUMENTS

| | | | | |
|---|---|---|---|---|
| 3,499,303 | A | 3/1970 | Spain | |
| RE30,198 | E | 1/1980 | Oliver et al. | |
| 4,756,177 | A | 7/1988 | Widén | |
| 4,815,307 | A * | 3/1989 | Widen | B21D 53/42 70/378 |
| 5,289,709 | A | 3/1994 | Field | |
| 5,475,998 | A | 12/1995 | Raskevicius et al. | |
| 5,715,717 | A | 2/1998 | Widen | |
| 6,477,875 | B2 | 11/2002 | Field et al. | |
| 8,281,628 | B2 * | 10/2012 | Widen | E05B 19/0035 70/358 |
| 2014/0216114 | A1 * | 8/2014 | Clifford | E05B 19/0029 70/490 |
| 2015/0240522 | A1 * | 8/2015 | Walls | E05B 19/0017 70/409 |

OTHER PUBLICATIONS

International Search Report issued by the International Searching Authority, International Application No. PCT/US2015/017339, May 22, 2015, 2 pages.
Written Opinion of the International Searching Authority, International Application No. PCT/US2015/017339; May 22, 2015, 6 pages.

* cited by examiner

*Primary Examiner* — Suzanne Barrett
(74) *Attorney, Agent, or Firm* — Taft Stettinius & Hollister LLP

(57) ABSTRACT

A progressive key notching system that includes a plurality of key notches positioned along at least one surface, such as, for example, a top surface, of a key blade. Each of the plurality of key notches includes a central axis. The central axes of at least one pair of adjacent key notches are separated by a distance that is different than a distance separating another, adjacent pair of key notches. Further, when the key blade is operably positioned within a key slot, at least one of the central axes may be offset from a chamber central axis of an adjacent retention pin chamber. Moreover, one or more of the chamber central axes may be aligned with a portion of a trailing surface and/or leading surface of an adjacent key notch.

20 Claims, 4 Drawing Sheets

VARIABLE PROGRESSION KEY NOTCHING SYSTEM

BACKGROUND OF THE INVENTION

Bitting configurations on keys are often utilized to control the operation of lock mechanisms. More specifically, the configuration of the bits, such as, for example, the depth, location, and number of key notches along a top portion of a key blade, is typically designed to control the displacement of components of the lock mechanism. Thus, when a key having the appropriate bitting configuration is inserted into the key slot of the mating lock, the bitting configuration may displace components of the lock mechanism so that the key may be used to rotate a component of the lock mechanism, such as, for example, a plug body that is operably connected to a lock device. Moreover, such rotation may be used to operate a lock device that is operably connected to the lock mechanism, such as, for example, a deadbolt.

One example of a lock mechanism that utilizes the bittings on a key in connection with operating a lock device is a tumbler pin lock mechanism. More specifically, tumbler pin lock mechanisms may utilize retention pins to control whether a plug body of a lock mechanism may be rotated about a shear line. Moreover, when properly inserted into the key slot, the bittings of a key may engage and displace tumbler pins to positions in which tumbler pins that are adjacent to the shear line do not extend across the operating shear line. With tumbler pins properly aligned with the shear line, a plug body of the lock mechanism may be rotated as the key is rotated, thereby operably displacing the attached lock mechanism.

Presently, key top notching is typically done at regular intervals along a key blade, such as, for example, at a repeated distance of 0.15 inches from a center line of a first key notch to the center line of a second, adjacent key notch. Moreover, key notching is often performed in accordance with a particular key system, which may define, for example, the number of bittings to be employed and the spacing between the bittings. Traditionally, such systems, and the associated rules of those systems, may determine the number of possible key cut combinations, and more specifically, the number of available bitting configurations. For example, the number of possible bitting configurations may be the number of key notch depths raised to a power that is equal to the number of cuts or key notches. Thus, if a system has four key notch depths and uses three cuts or key notches, then the number of possible bitting configurations may be four to the power of three. Therefore, the number of possible key notch configurations for such systems are typically dependent on key notch depths.

BRIEF SUMMARY OF THE INVENTION

One aspect of the present invention is a key that is configured for insertion into a key slot of a lock mechanism. The key includes a key blade having a plurality of surfaces. Further, a plurality of key notches are positioned along at least one of the plurality of surfaces. Each of the plurality of key notches includes a central axis. The central axes of a first pair of adjacent key notches of the plurality of key notches are separated by a first distance. Additionally, the central axes of a second pair of adjacent key notches are separated by a second distance, with the second distance is not being equal to the first distance.

Another aspect of the present invention is a progressive key notching system having a key having a key blade. The key blade includes a plurality of key notches, each of the plurality of key notches having a central axis. Additionally, the distance between the central axes of at least one, adjacent pair of the plurality of key notches is different than the distance been the central axes of another, adjacent pair of the plurality of key notches. The progressive key notching system also includes a plug body having a plurality of chambers. Each of the plurality of chambers has a chamber central axis and is configured to contain at least one retention pin. When the key blade is operably positioned within a key slot of the plug body, at least one chamber central axis is offset from the central axis of an adjacent key notch of the plurality of key notches.

Another aspect of the present invention is a progressive key notching system that includes a key having a key blade. The key blade has a plurality of key notches, each of the plurality of key notches having a central axis. The distance between the central axes of at least one pair of adjacent key notches of the plurality of key notches is different than the distance been the central axes of another pair of adjacent key notches of the plurality of key notches. The progressive key notching system also includes a plug body having a plurality of chambers and a key slot, each of the plurality of chambers having a chamber central axis. The system further includes at least one retention pin positioned at least within each of the plurality of chambers. The retention pin is configured for lateral displacement along the chamber central axis and includes at least one recess that is configured to receive at least a portion of a control bar. Additionally, when the key blade is operably positioned within the key slot, the chamber central axis of at least one chamber of the plurality of chambers is offset from the central axis of an adjacent key notch of the plurality of key notches. Further, the retention pin is configured to be rotated and laterally displaced within the at least one chamber upon engagement with the adjacent key notch so that the at least one recess is positioned to receive at least a portion of the control bar.

Figure 1:
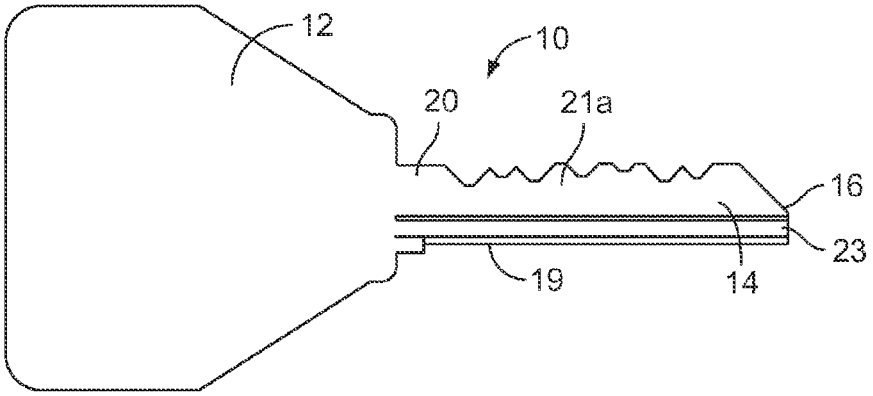
FIG. 1 illustrates a side view of a key having variable key notching according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

Embodiments of the present invention provide a progressive key notching system that utilizes key notches that are placed at varying locations along a key blade. Moreover, embodiments of the present invention provide for a key system that utilizes irregular spacing between key notches on or about a top surface of a key blade to control the operation of an associated lock mechanism.

Figure 2:
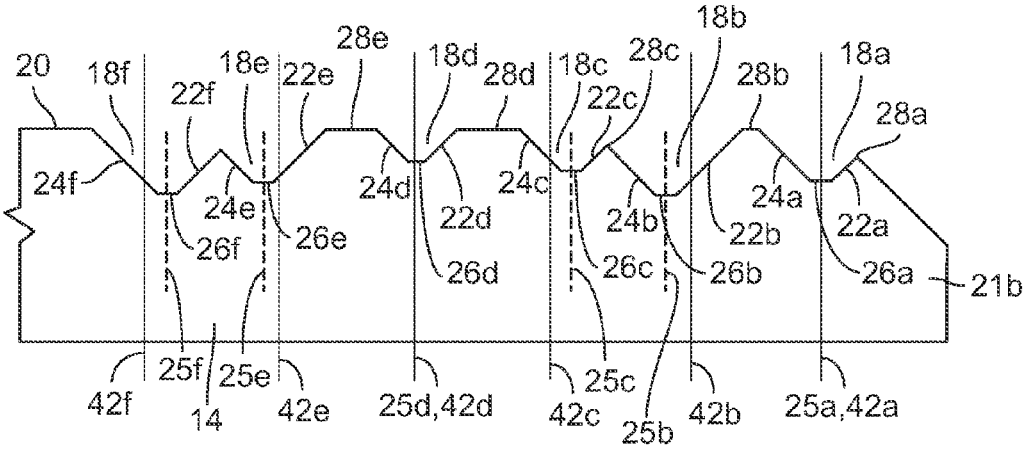
FIG. 2 illustrates a blade portion of the key of FIG. 1 having variable key notching according to an embodiment of the present invention.

FIGS. 1 and 2 illustrate a key 10 having a bow 12 and a key blade 14. The illustrated key blade 14 extends from the bow 12 and generally terminates at a tip portion 16 of the key blade 14. The key blade 14 also includes a bottom surface 19, top surface 20, and opposing side surfaces 21*a*, 21*b*. According to certain embodiments, at least one of the side surfaces 21*a*, 21*b* includes a longitudinal groove 23 that extends along a substantial portion of the sidewall 21*b*. According to certain embodiments, the longitudinal groove 23 may be configured to mate a protrusion in a key slot of a lock mechanism, the protrusion being configured to limit which keys may be inserted into the key slot. Additionally, a plurality of key notches 18*a-f* are positioned about or cut from at least one surface of the key blade 14, such as, for example, a top surface 20 of the key blade 14.

As shown in FIGS. 1 and 2, each key notch 18*a-f* that is positioned about the top surface 20 of the key blade 14 includes a leading surface 22*a-f* and a trailing surface 24*a-f* that extend in opposing directions from a base portion 26*a-f* of the key notch 18*a-f*. In the illustrated embodiment, the leading surface 22*a-f* may ascend from the base portion 26*a-f* at an incline that is generally in direction of the tip portion 16 of the key blade 14 until terminating at an upper surface 28*a-f* of the top surface 20. Similarly, the trailing surface 24*a-f* may ascend from the base portion 26*a-f* at an incline that is generally in the direction of the bow 12 until also terminating at an adjacent upper surface 28*a-f*.

The upper surface 28*a-f* between adjacent key notches 18*a-f* may have a variety of different shapes and sizes. Moreover, the size, shape, length and/or height of the upper surface 28*a-f* may depend, at least in part, on the depth, positioning, and/or spacing between adjacent key notches 18*a-f*. For example, as shown in at least FIG. 2, the upper surface 28*b* between adjacent first and second key notches 18*a*, 18*b* may have a generally flat shape that is at the same height as of the top surface 20 of the key blade 14, while the upper surface 28*c* between adjacent second and third key notches 18*b*, 18*c* may have a relatively pointed shape and a height that is generally below the highest portion of the top surface 20.

Referencing FIGS. 3A-4B, the key notches 18*a-b* are configured to engage, and displace, retention pins 30 that are housed in retention pin chambers 36*a-f* of a lock mechanism, such as, for example, a plug body 38. The retention pins 30 may have a variety of different shapes and sizes. For example, in the embodiment shown in FIGS. 3A-3B, the retention pin 30 includes a pin body 34 having opposing face and back portions 50, 51 and an extension 44. The pin body 34 is generally configured to be displaced within a retention pin chamber 36*a-f*. The extension 44 is configured to extend from the back portion 51 of the pin body 34 and into a portion of a key slot 39 in the plug body 30.

Figure 4A:
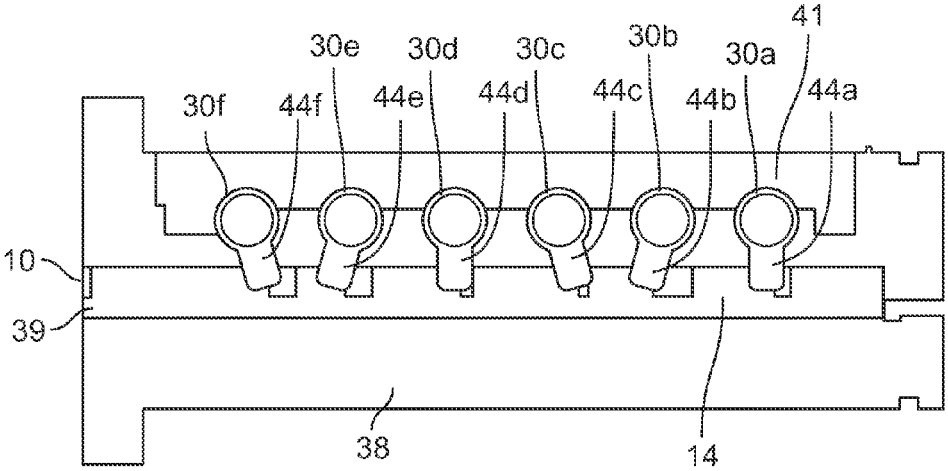
FIGS. 4A-4B illustrate top and side views, respectively, of a plurality of rotatable pins positioned within retention pin chambers of a plug body.

According to certain embodiments, the pin body 34 may include one or more recesses 32 that is/are positioned about the face portion 50 of the pin body 34. Referencing FIG. 5, the recesses 32 may, for example, be configured to receive a portion of a control bar 40 that is used to control the ability to rotate the plug body 37. For example, the control bar 40 may be biased to a first position, wherein at least a portion of the control bar 40 extends along or across at least a portion of a shear line between the plug body 38 and a shell body 37. The presence of the control bar 40 along the shear line may prevent the plug body 38 from being rotably displaced relative to the shell body 37. However, when the retention pins 30*a-f* are properly aligned, the recesses 32 in the retention pins 30*a-f* may provide a space(s) that is/are configured to receive at least a portion of the control bar 40. Thus, with the recesses 32 properly aligned, as shown for example in FIG. 4B, the control bar 40 may be able to be displaced in a direction away from the shear line and to a second position wherein the control bar 40 does not prohibit the rotational displacement of the plug body 37 about the shear line. For example, in the embodiment illustrated in FIG. 4A, the proper alignment of the recesses 32 of the retention pins 30*a-f* may allow the control bar 40 to be retracted further into a groove 41 in the plug body 38 so that the control bar 40 does not prevent the rotational displacement of the plug body 38.

Figure 3A:
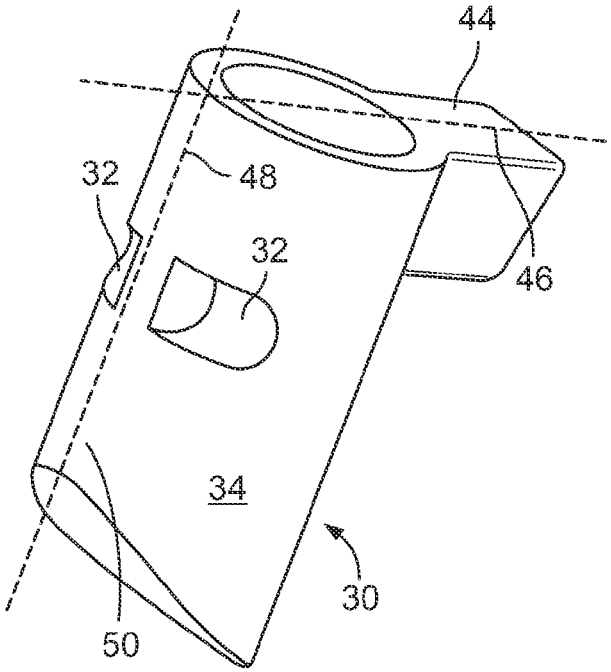
FIGS. 3A-3B illustrate a side perspective view and a side view, respectively, of an example of a rotatable pin that is configured for use with a key having variable key notching according to an embodiment of the present invention.
Figure 3B:
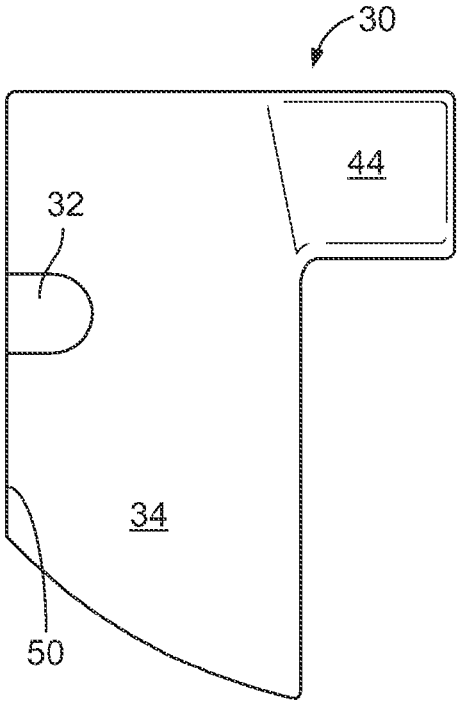

As shown in FIG. 3A, according to certain embodiments, the recesses 32 may be positioned relative to a centerline 48 of the face portion 50 that is generally perpendicular to, and intersects, a centerline 48 of the extension 44. Further, the position of a recess 32 in the pin body 34 relative to the centerline 48 may determine whether that recess 32 is center, left, or right cut. For example, the recess 32 shown in FIGS. 3A and 3B is center cut, as the recess 32 is generally centered about the centerline 48. However, if the center of the recess 32 is generally offset to the right of the centerline 48, then the recess 32 may be considered right cut. Similarly, if the center of the recess 32 is offset to the left of the centerline 48, then the recess 32 may be considered left cut. By centering and offsetting such recesses 32, lateral displacement of the retention pins 30 by the key notches 18*a-f* may require not only that the retention pins 30 are at the correct location along the chamber center axis 42*a-f* of the corresponding retention pin chamber 36*a-f*, but also that retention pins 30 be rotated to a correct angular position about the retention pin chamber 36*a-f* so that the recesses 32 are properly aligned to permit displacement of the control bar 40 to the second position. As discussed below, according to embodiments of the present invention, such lateral displacement along the chamber central axis 42*a-f* and rotation of the retention pins 30 may be provided by positioning the key notches 18*a-f* at one or more irregular intervals along the top surface 20 of the key blade 14.

Each key notch 18*a-f* may have a central axis 25*a-f* that generally extends through a center point of the base portion 26*a-f* of the key notch 18*a-f*. According to certain embodiments, the distance between the central axes 25*a-f* of two adjacent key notches 18*a-f* is not equal to the distance between the central axes 25*a-f* of another combination of adjacent key notches 18. For example, referencing FIG. 2, according to certain embodiments, the distance between a central axis 25*a* of a first key notch 18*a* and a central axis 25*b* of a second key notch 18*b* may be less than or greater than the distance separating the central axis 25*b* of the second key notch 18*b* from a central axis 25*c* of a third key notch 18*c*. Similarly, according to certain embodiments, the distance between central axes 25*c*, 25*d* of the third key notch 18*c* and a fourth key notch 18*d* may be different than the distance(s) between the central axes 25*a*, 25*b* of the first and second key notches 18*a*, 18*b* and/or the distance between the central axes 25*b*, 25*c* of the second and third key notches 18*b*, 18*c*.

Figure 4B:
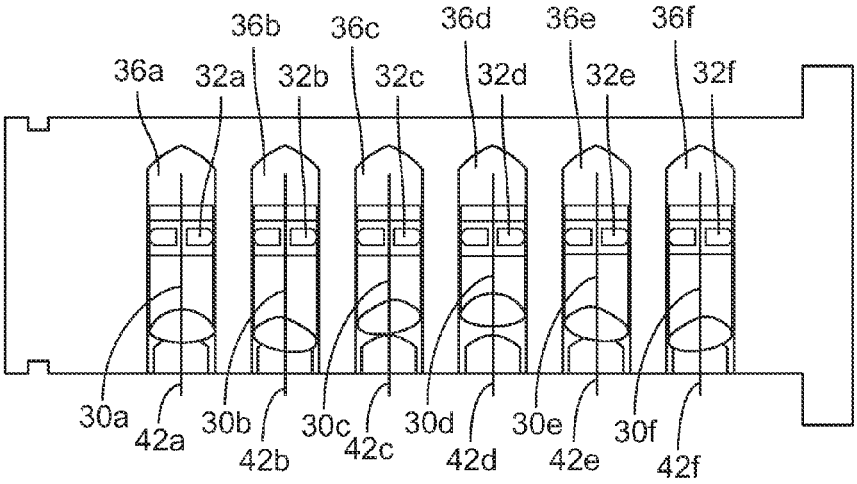
Figure 5:
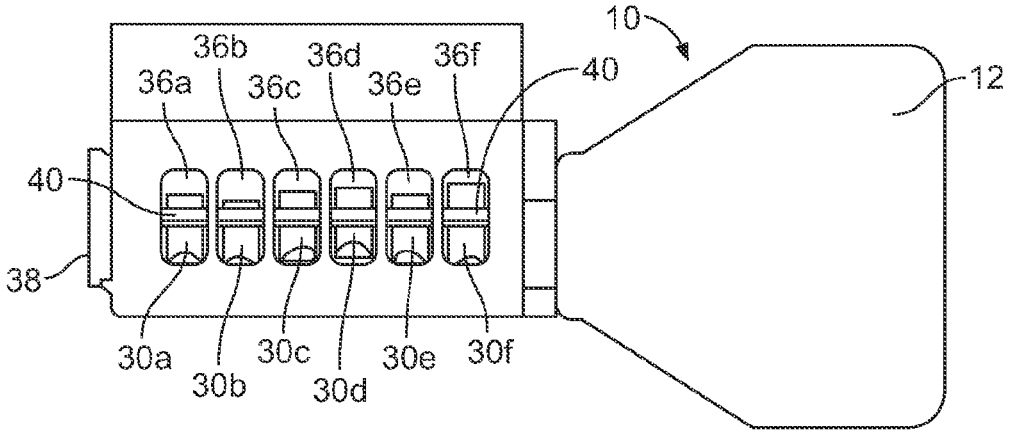
FIG. 5 illustrates a side view of a lock mechanism having rotatable pins configured to be operably positioned by a key having a variable key notching configuration to control the displacement of a control bar.

Referencing at least FIGS. 2 and 4B, such variances in the distances separating the central axes 25*a-f* of the key notches 18*a-f* may allow for misalignment between at least some of the central axes 25*a-f* of the key notches 18*a-f* and the chamber central axes 42*a-f* of the corresponding retention pin chambers 36*a-f* of the plug body 38. As a result, when the key blade 14 is operably positioned in the key slot 39, rather than being generally aligned with a center point on the base portion 26*a-f* of the notches 18*a-f*, at least some of the chamber central axes 42*a-f* of the retention pin chambers 36*a-f* may be aligned with a location on the leading surface 22*a-f* or trailing surface 24*a-f* of the key notch 18*a-f*.

For example, in the embodiment shown in FIG. 2, the chamber central axes 42*b*, 42*e* for the second and fifth retention pin chambers 36*b*, 32*e* intersect a portion of the leading surfaces 22*b*, 22*e* of the corresponding second and fifth key notches 18*b*, 18*e*. According to such a configuration, upon operable positioning of the key 10 in the key slot 39, the extension 44 of the retention pin 30*b*, 30*e* in the second and fifth retention pin chambers 36*b*, 36*e* may be in contact with the leading surface 22*b*, 22*e* of the corresponding notches 18*b*, 18*e*. Such engagement may not only cause these retention pins 30*b*, 30*e* to be laterally displaced along the chamber central axis 42*b*, 42*e* of the retention pin chamber 36*b*, 36*e*, but also cause those retention pins 30*b*, 30*e* to be rotated in the general direction of the bow 12, as shown for example in FIG. 4A. Additionally, the recesses 32*b*, 32*e* in the second and fifth retention pins 30*b*, 30*e* are positioned accordingly on the pin body 34*b*, 34*e* so that, when the retention pins 30*b*, 30*e* are rotated by engagement with the corresponding key notches 18*b*, 18*e*, the recesses 32*b*, 32*e* are properly aligned so as to accept a portion of the control bar 40 as the control bar 40 is displaced to the second position. For example, according to the illustrated embodiment, the recesses 32*b*, 32*e* in the second and fifth retention pins 30*b*, 30*e* may be offset to the right of the centerline 48 that is positioned along the face portion 50 of the retention pins 30*b*, 30*e*. Such offsetting may allow the recesses 32*b*, 32*e* to generally face the control bar 40 when the retention pins 30*b*, 30*e* are rotated by engagement with the corresponding key notches 18*b*, 18*e*, and thereby allow the recesses 32*b*, 32*e* to receive a portion of the control bar 40 as the control bar 40 is displaced to the second position.

Conversely, in the present example, the third and sixth key notches 18*c*, 18*f* may be positioned along the top surface 20 of the key blade 14 so that the central axes 42*c*, 42*f* of the third and sixth retention pin chambers 36*c*, 32*f* intersect a portion of the trailing surfaces 24*c*, 24*f* of the corresponding third and sixth key notches 18*c*, 18*f*. According to such a configuration, upon operable positioning of the key 10 in the key slot 39, the extension 44 of the retention pin 30*c*, 30*f* in the third and sixth retention pin chambers 36*c*, 36*f* may be in contact with the trailing surfaces 24*c*, 24*f* of the corresponding notches 18*c*, 18*f*. Such engagement may not only cause these retention pins 30*c*, 30*f* to be laterally displaced along the chamber central axis 42*c*, 42*f* of the retention pin chamber 36*c*, 36*f*, but also cause those retention pins 30*c*, 30*f* to be rotated in the general direction of the tip portion 16 of the key blade, as shown for example in FIG. 4A. Additionally, the recesses 32*c*, 32*f* in the trailing surfaces 24*c*, 24*f* retention pins 30*c*, 30*f* are positioned accordingly on the pin body 34*c*, 34*f* so that, when the retention pins 30*c*, 30*f* are rotated by engagement with the corresponding key notches 18*c*, 18*f*, the recesses 32*c*, 32*f* are properly aligned so as to not interfere with the ability of the control bar 40 to be displaced to the second position. For example, according to the illustrated embodiment, the recesses 32*c*, 32*f* in the third and sixth retention pins 30*c*, 30*f* may be offset to the left of the centerline 48 that is positioned along the face portion 50 of the retention pins 30*c*, 30*f*. Such offset positioning of the recesses 32*c*, 32*f* may allow the recesses 32*c*, 32*f* to be properly aligned with the control bar 40 when the associated retention pins 30*c*, 30*f* have been rotated by engagement with the appropriate key notches 18*c*, 18*f* of the key blade 14. Moreover, such alignment of the recesses 32*c*, 32*f* may at least assist in allowing the control bar 40 to be displaced to the second position.

Additionally, in the illustrated example, the first and fourth key notches 18*a*, 18*d*, may be positioned so that the central axis 25*a*, 25*d* of the first and fourth key notches 18*a*, 18*b* are aligned with the chamber central axis 42*a*, 42*d* of the corresponding first and fourth retention pin chambers 36*a*, 36*d* of the plug body 38. Accordingly, when the key 10 is operably positioned in the key slot 39, the extensions 44*a*, 44*d* of the first and fourth retention pins 30*a*, 30*d* will engage at least the base portion 26*a*, 26*b* of the notches 18*a*, 18*d* so as to laterally displace, but not generally rotate, the first and fourth retention pins 30*a*, 30*d* along the chamber central axis 42*a*, 42*d*, as shown in FIG. 4A. Thus, according to such an embodiment, the recesses 32*a*, 32*d* in the pin body 34*a*, 34*d* of the first and fourth retention pins 30*a*, 30*d* may be center cut, as shown in at least FIG. 3A.

Thus, by varying the distance between key notches 18*a-f* along the top surface 20 of the key blade 14, the system of the present invention not only utilizes the depth of key notches 18*a-f*, but also utilizes the location of where the key notches 18*a-f* are cut along the key blade 14, to control the operation of the lock mechanism, such as, for example, the ability to rotate the plug body 38. Therefore, for example, using the variable progression notching system of the present invention, the number of possible bitting combinations may be determined based on the product of the number of key notch depths (N) and the number of possible distance variations (Y) raised to a power based on the number (x) of key notches 18*a-f*, or (N*Y)^x. Thus, the variable progression notching system of the present invention may expand the number of possible bitting combinations for many lock mechanism applications. Further, the variable progression notching system may increase the number of useable bitting combinations for applications that may have a reduced number of available cut depths, such as applications in which vertical constraints limit the possible number of cut depths.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A key configured for insertion into a key slot of a lock mechanism, the key comprising:

a key blade having a plurality of surfaces; and a plurality of key notches positioned along at least one of the plurality of surfaces, each of the plurality of key notches having a central axis, the central axes of a first pair of adjacent key notches of the plurality of key notches being separated by a first distance, the central axes of a second pair of adjacent key notches of the plurality of key notches being separated by a second distance, and wherein the second distance is not equal to the first distance.

2. The key of claim 1, wherein the at least one of the plurality of surfaces includes a top surface.

3. The key of claim 2, wherein the first distance is greater than the second distance, and wherein the central axes of a third pair of adjacent key notches of the plurality of key notches are separated by a third distance, the third distance being larger than the first distance.

4. The key of claim 2, wherein, when the key blade is operably positioned in the key slot, the central axis of at least one of the plurality of key notches is configured to be offset from a chamber central axis of an adjacent retention pin chamber of the lock mechanism.

5. The key of claim 4, wherein, when the key blade is operably positioned in the key slot, the central axis of at least a second one of the plurality of key notches is configured to be generally aligned with the chamber central axis of an adjacent retention pin chamber of the lock mechanism.

6. The key of claim 4, wherein the plurality of key notches each include a leading surface, a trailing surface, and a base portion, the leading and trailing surfaces being inclined surfaces that extend in opposing directions from the base portion, and wherein at least one of the plurality of key notches is configured for, when the key blade is operably positioned in the key slot, the chamber central axis of an adjacent retention pin chamber of the lock mechanism to be generally aligned with at least one of the leading surface and the trailing surface.

7. A progressive key notching system comprising:

a key having a key blade, the key blade having a plurality of key notches, each of the plurality of key notches having a central axis, the distance between the central axes of at least one, adjacent pair of the plurality of key notches being different than the distance been the central axes of another, adjacent pair of the plurality of key notches; and a plug body having a plurality of chambers, each of the plurality of chambers having a chamber central axis and configured to contain at least one retention pin, wherein, when the key blade is operably positioned within a key slot of the plug body, at least one chamber central axis is offset from the central axis of an adjacent key notch of the plurality of key notches.

8. The progressive key notching system of claim 7, wherein, when the key blade is operably positioned in the key slot, the central axis of at least a second one of the plurality of key notches is configured to be generally aligned with the chamber central axis of an adjacent chamber of the plurality of chambers.

9. The progressive key notching system of claim 8, wherein the plurality of key notches each include a leading surface, a trailing surface, and a base portion, the leading and trailing surfaces being inclined surfaces that extend in opposing directions from the base portion, and wherein at least one of the plurality of key notches is configured for, when the key blade is operably positioned in the key slot, the central axis of an adjacent chamber of the plurality of chambers to be generally aligned with a portion of at least one of the leading surface and the trailing surface.

10. The progressive key notching system of claim 9, wherein the plurality of key notches are positioned about at least a top surface of the key blade.

11. The progressive key notching system of claim 10, wherein the central axes of at least three pairs of adjacent key notches of the plurality of key notches are separated by different distances.

12. The progressive key notching system of claim 10, wherein, when the key blade is operably positioned in the key slot, the central axis for at least one of the plurality of key notches is configured to be generally aligned with the chamber central axis of an adjacent chamber of the plurality of chambers.

13. A progressive key notching system comprising:

a key having a key blade, the key blade having a plurality of key notches, each of the plurality of key notches having a central axis, the distance between the central axes of at least one pair of adjacent key notches of the plurality of key notches being different than the distance been the central axes of another pair of adjacent key notches of the plurality of key notches;

a plug body having a plurality of chambers and a key slot, each of the plurality of chambers having a chamber central axis; and at least one retention pin positioned at least within each of the plurality of chambers, the retention pin configured for lateral displacement along the chamber central axis, the at least one retention pin including at least one recess configured to receive at least a portion of a control bar;

wherein, when the key blade is operably positioned within the key slot, the chamber central axis of at least one chamber of the plurality of chambers is offset from the central axis of an adjacent key notch of the plurality of key notches, and further wherein at least one of the at least one retention pin is configured to be rotated and laterally displaced within the at least one chamber upon engagement with the adjacent key notch to position the at least one recess to receive at least a portion of the control bar.

14. The progressive key notching system of claim 13, wherein, when the key blade is operably positioned in the key slot, the central axis of at least a second one of the plurality of key notches is configured to be generally aligned with the chamber central axis of an adjacent chamber of the plurality of chambers.

15. The progressive key notching system of claim 14, wherein the plurality of key notches each include a leading surface, a trailing surface, and a base portion, the leading and trailing surfaces being inclined surfaces that extend in opposing directions from the base portion, and wherein at least one of the plurality of key notches is configured for, when the key blade is operably positioned in the key slot, the central axis of an adjacent chamber of the plurality of chambers to be generally aligned with a portion of at least one of the leading surface and the trailing surface.

16. The progressive key notching system of claim 15, wherein, when the key blade is operably positioned within the key slot, at least one key notch is positioned for an adjacent chamber of the plurality of chambers to be generally aligned with a portion of the leading surface, and wherein at least one other key notch is positioned for an adjacent chamber of the plurality of chambers to be generally aligned with a portion of the trailing surface.

17. The progressive key notching system of claim 16, wherein the plurality of key notches are positioned about at least a top surface of the key blade.

18. The progressive key notching system of claim 17, wherein the central axes of at least three pairs of adjacent key notches of the plurality of key notches are separated by different distances.

19. The progressive key notching system of claim 18, wherein the at least one retention pin includes an extension that is configured to extend into at least a portion of the key slot.

20. The progressive key notching system of claim 19, wherein the at least one recess of at least one of the at least one retention pin is positioned offset from a center line along a face portion of the pin body, the center line positioned to generally intersect a centerline of the extension.

* * * * *